US006396383B1

(12) United States Patent
Glatz-Reichenbach et al.

(10) Patent No.: US 6,396,383 B1
(45) Date of Patent: May 28, 2002

(54) PROTECTIVE ELEMENT

(75) Inventors: Joachim Glatz-Reichenbach, Baden-Dättwil; Felix Greuter, Baden-Rütihof; Ruzica Loitzl-Jelenic, Kirchdorf, all of (CH); Jörgen Skindhoj, Frederiksberg (DK); Ralf Strümpler, Gebenstorf (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/208,479

(22) Filed: Dec. 10, 1998

(30) Foreign Application Priority Data

Dec. 11, 1997 (DE) ..... 197 54 976

(51) Int. Cl.[7] ..... H01C 7/10
(52) U.S. Cl. ..... 338/22 R; 338/22 R
(58) Field of Search ..... 338/22 R, 225 D

(56) References Cited

U.S. PATENT DOCUMENTS

| | | | | |
|---|---|---|---|---|
| 3,243,753 A | | 3/1966 | Kohler | |
| 4,534,889 A | * | 8/1985 | Konynenburg et al. | 252/511 |
| 4,775,778 A | * | 10/1988 | Konynenburg et al. | 219/549 |
| 4,859,836 A | * | 8/1989 | Lunk et al. | 219/548 |
| 4,873,507 A | | 10/1989 | Antonas | |
| 5,003,208 A | * | 3/1991 | Hama et al. | 310/68 C |
| 5,451,919 A | | 9/1995 | Chu et al. | |
| 5,554,679 A | | 9/1996 | Cheng | |
| 5,602,520 A | * | 2/1997 | Baiatu et al. | 338/22 R |
| 6,191,681 B1 | * | 2/2001 | Cole et al. | 338/22 R |

FOREIGN PATENT DOCUMENTS

DE 4221309 A1 1/1994

OTHER PUBLICATIONS

"Phase change materials for thermal stabilization of composite thermistors", Brodeur, et al., J. Mater. Res. vol. 6, No. 1, Jan. 1991, pp. 175–182.

"Uberstromschutz mit Polymer–PTCs", Fang, et al., Elektronik 26/1995, pp. 60–66.

"Kaltleiter", Siemens Matsushita Components publication, 1996, various pages.

* cited by examiner

*Primary Examiner*—Karl D. Easthom
(74) *Attorney, Agent, or Firm*—Burns, Doane, Swecker & Mathis, L.L.P.

(57) ABSTRACT

A protective element for protecting in particular an electric motor against overload currents includes in a polymer matrix, preferably ETFE, for example 40% (by volume) of a first powdered filler of a conductive material, preferably $TiB_2$, so that, as in the case of a PTC element, the resistance increases abruptly at a switching temperature corresponding to the melting temperature of the polymer. Also added are 20% (by volume) of a second powdered filler, a phase transition material which, at a critical temperature below the switching temperature, undergoes a phase transition in which it absorbs heat of transformation. As a result, the response time (T) of the protective element is notably extended in a range of the overload current factor (F) corresponding to higher permissible motor starting currents. Examples of materials which come into consideration for the second filler are those with a solid-solid phase transition such as pentaerythritol, $NaNO_2$, $NaNO_3$ or else with a solid-liquid phase transition such as UHMWPE, quinol or, in particular, microencapsulated metals, alloys and salts.

14 Claims, 2 Drawing Sheets

PROTECTIVE ELEMENT

BACKGROUND OF THE INVENTION

1. Field of the Invention

The invention relates to a protective element for protecting a current consumer against overloading. Resistance elements, known as PTC elements, which have a polymer matrix and a powdered filler of conductive material embedded in said matrix have been known for some time. The resistance of these elements increases abruptly by several orders of magnitude if the temperature of the resistance element reaches a switching temperature. It corresponds to the melting point of the polymer, at which the particles of the filler are separated by the melting of the matrix.

One of the ways in which this effect can be used is for current limitation, in particular for interrupting overload currents. In this case, a resistance element which remains at a temperature in the highly conductive range under a nominal current, but is heated by an overload current to such an extent that it reaches the switching temperature, is connected in series with the current consumer as a protective element.

2. Discussion of Background

It has also already been proposed (J. Mater. Res. 6/1 (1991)) to prevent overheating of the polymer in PTC resistors by providing a further powdered filler which, at a critical temperature above this switching temperature, undergoes a phase transition in which it absorbs heat of transformation, so that further heating of the resistor core is prevented, or at least delayed.

Protective elements in which the trigger characteristic, i.e. the response time as a function of the overload current factor, has a specific form are required for various applications. If the overload current amounts to a certain multiple of a nominal current, the protective element is intended to interrupt the current after a certain time, which is dependent on this factor. This applies in particular to motor protective circuits which are in series with an electric motor and must withstand an increased motor starting current, which is for example up to 5 to 10 times the nominal current, for a certain time, for example 1 to 10 seconds. Subsequently, the limit value at which the motor protective circuit interrupts the current is intended to fall virtually to the nominal current, so that only a small overload current is tolerated over a prolonged period to avoid thermal overloading of the motor.

Such motor protective circuits can currently be realized only by relatively elaborate arrangements of different switching elements connected in series, for example a fuse reacting quickly to short, high levels of overload current, such as those caused by lightning strikes, a switch responding to rather more prolonged, more moderate overload currents, such as short-circuit currents for example, and a thermal relay interrupting low overload currents if they persist.

SUMMARY OF THE INVENTION

Accordingly, one object of the invention is to provide a novel protective element which has for such tasks a response time which is suitably dependent on the overload current factor and which is therefore adequate within a relatively simple circuit, preferably alone or in series with just one switch or disconnector, for performing such a protective task.

This object is achieved by the invention in the way set out in the defining part of patent claim 1. While conventional PTC resistors for instance have a trigger characteristic which, if correctly set in the range of short, high overload currents and prolonged, low overload currents, responds too quickly under customary motor starting currents or, conversely, allows the required motor starting currents but responds too slowly under short, high overload currents and, in particular, under low, prolonged overload currents, this can be corrected by the measure according to the invention in that the heating of the resistance element in the range of likely motor starting currents is deliberately delayed and the response time is extended as a result.

The advantages achieved by the invention are, in particular, that it makes it possible to produce protective elements for the protection of sensitive components against overload currents which are of a simple structural design, are reliable and can be produced at relatively low cost. Protective elements according to the invention are particularly suitable as motor protective circuits for electric motors or as components of such circuits.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
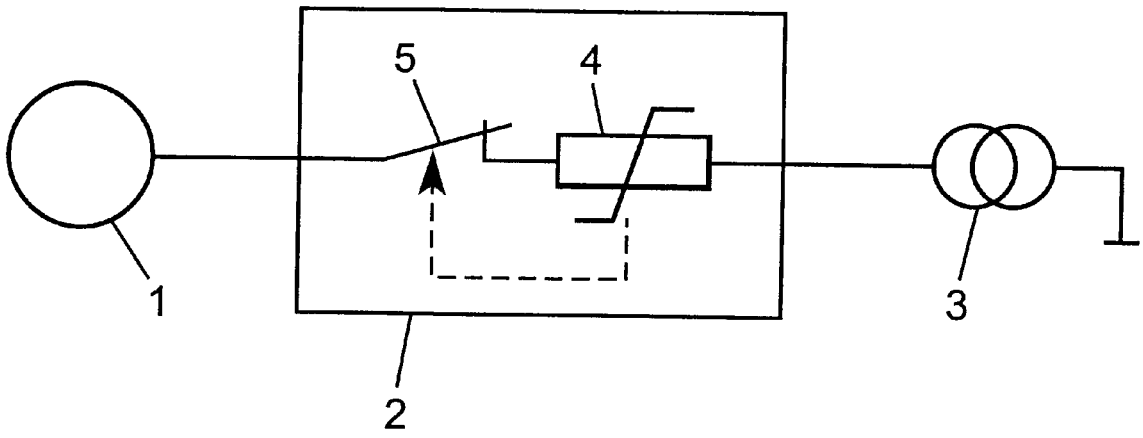
FIG. 1 shows a circuit diagram including an electric motor and a motor protective circuit with a protective element according to the invention.

Protective elements according to the invention have in each case, in a known way, a resistor core provided with two contact electrodes. According to a first exemplary embodiment, the resistor core is composed as follows: a heat-resistant thermoplastic, preferably ETFE, for example Hostaflon® from Hoechst AG, with a melting point between 210° C. and 270° C., but at least 200° C., serves as the matrix material. As a proportion of the mass of the resistor core, this amounts to 40% (by volume). $TiB_2$ powder is mixed in as the first filler, likewise in a proportion of 40% (by volume). The material has a very high conductivity, so that the protective element offers little resistance at low temperatures. The remaining 20% (by volume) is accounted for by a second filler, pentaerythritol, which is likewise added in powder form. This phase transition material has a solid-solid phase transition at a critical temperature of $T_c$=187° C., at which it absorbs 505 J/cm$^3$ of the heat of transformation.

In the case of a protective element according to a second exemplary embodiment, the same matrix material and the same first filler are used in the same proportions as in the first embodiment. UHMWPE is added in powder form as the second filler, likewise in a proportion of 20% (by volume). Such a polymer, which melts at 135° C., can likewise be obtained from the Hoechst company. This phase transition material absorbs 186 J/cm$^3$ of the heat of transformation during melting. It is then still highly viscous, so that its phase transition has no further significant effect on the state of the resistor core.

Many other compositions of the resistance material for the protective element are of course possible. In particular, powder of ferroelectric material, such as $NaNO_2$ or $NaNO_3$, may be used as the second filler. These phase transition materials have a solid-solid phase transition at $T_c$=162° C. and 275° C., respectively, and absorb 40.1 J/cm$^3$ and 209 J/cm$^3$ of the heat of transformation, respectively.

In addition, phase transition materials which melt at a relatively low temperature, that is to say have a solid-liquid phase transition, may be used. Materials which particularly come into consideration here are metals and alloys, for example Sn with a melting point of $T_c$=157° C. or Sn/Pb-63/37 with $T_c$=183° C., but also salts or organic substances such as quinol with $T_c$=172° C. Melting materials in microencapsulated form are preferably used, since otherwise there is the risk that the melting of the material will induce irreversible changes in the resistor core. Such materials are offered, for example, by Triangel Research and Development Corporation. Phase transition materials which have a relatively great heat of transformation, for example at least 40 J/cm$^3$, are preferably used.

Apart from high-melting thermoplastics, polyethylene, which melts at about 135° C., also comes into consideration as the matrix material, which polymer matrix material includes polyethylene. This corresponds to the switching temperature of the protective element, so that the critical temperature $T_c$ of the second filler should be lower. Of course, a material other than $TiB_2$ may also be chosen for the first filler.

At current levels up to a certain nominal current, the particles of the first filler are in contact with one another and form continuous current paths. The temperature of the resistor core is stable and the protective element has low electrical resistance. At higher currents, said particles heat up increasingly and, by being in contact with it, also cause the polymer matrix to heat up, until it melts when it reaches the switching temperature. The particles of the first filler are separated as a result and the resistance of the protective element increases rapidly by several orders of magnitude. The response time which elapses before the switching temperature is reached depends on the energy consumption, and this in turn depends on the overload current factor, i.e. the quotient $I/I_n$ between the actual current I and the nominal current $I_n$.

In the case of a protective element according to the invention, when the overload current factor is not at very high values, the temperature increase in the resistor core is slowed down by the heat of transformation which the second filler absorbs in its phase transition. As a result, the switching temperature is reached later and the response characteristic is raised. On the other hand, at very high overload currents, the switching temperature is reached before a phase transition can occur, so that the said transition does not have any effect on the response time. At a low overload current factor, the response time is in turn so great that the delay brought about by the phase transition is negligible. The extending of the response time by the phase transition can be influenced in each case by the apportioning of the second filler and its heat of transformation. One of the factors on which the current level at which the effect occurs depends is the speed with which the phase transition occurs, and this can be controlled, at least within certain limits, by the particle size of the second filler. It is of course possible also to set more complicated characteristics, for instance by the second filler being composed of two or more phase transition materials which undergo phase transformations at different critical temperatures.

As explained, the phase transition of the second filler thus brings about a noticeable extension of the response time of the protective element, in particular in a cerzain overload current range. This can be utilized in a motor protective circuit, as can be seen in FIG. 1. Referring to the figure, an electric motor 1 is connected in series with a motor protective circuit 2 and a current source 3. The motor protective circuit 2 includes a protective element 4 according to the invention and a switch 5, which is opened after any response by the protective element 4.

Figure 2:
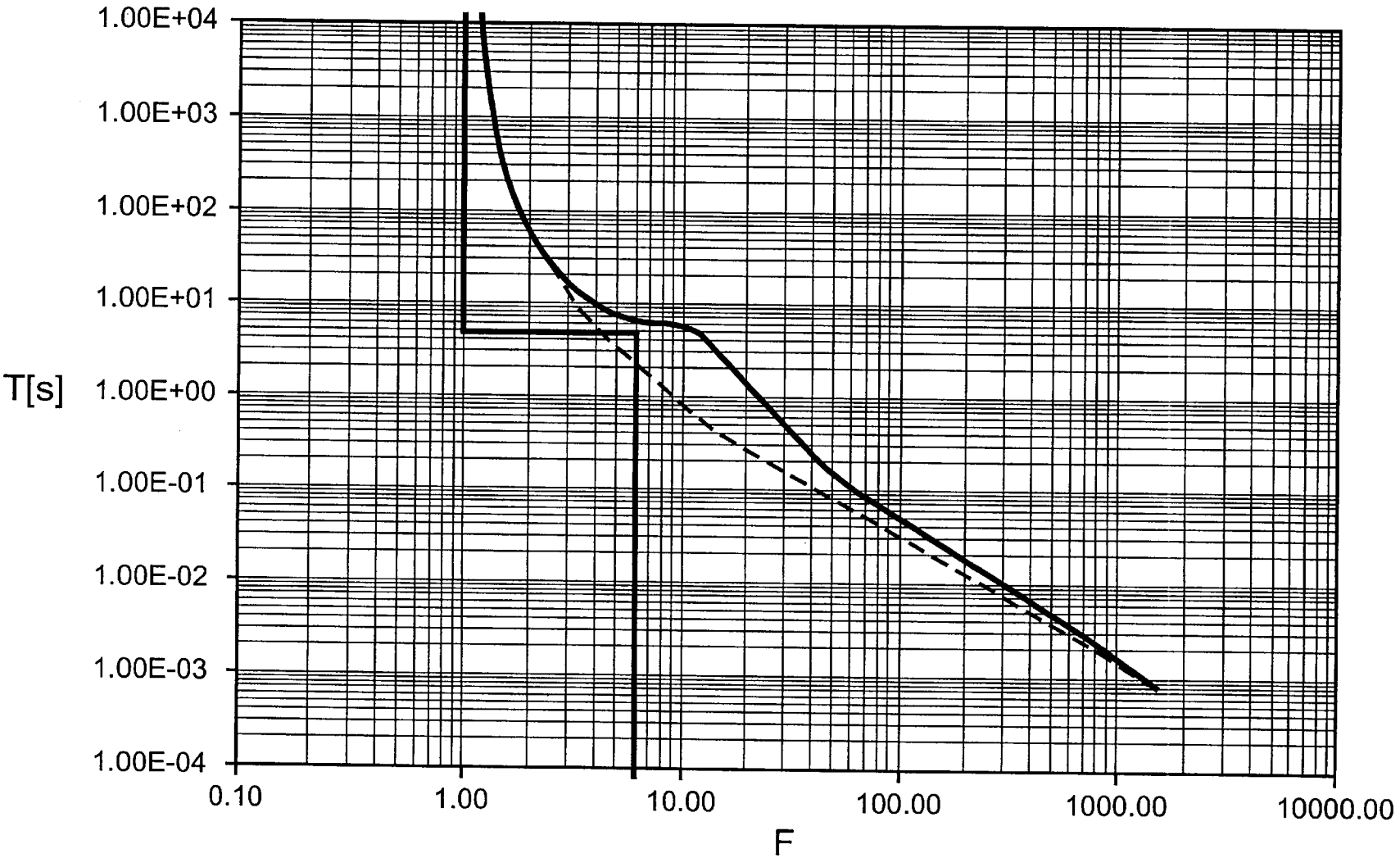
FIG. 2 shows the response time as a function of the overload current factor for a known resistance element of the generic type and for a protective element according to the invention, as well as the limit values for a dermissible motor starting current.

In FIG. 2, the response time T of a typical known protective element of the generic type, comprising 50% (by volume) of ETFE as the matrix material and 50% (by volume) of the first filler, is represented as a function of the overload current factor $F=I/I_n$ by broken lines and the corresponding function of a protective element according to the invention, in which 40% (by volume) of ETFE are mixed with 40% (by volume) of $TiB_2$ and 20% (by volume) of UHMWPE, is represented by solid lines. Likewise represented by solid lines are the permissible duration of the motor starting current and the overload current factor corresponding to the permissible limit valve of the latter.

The two protective elements are rated such that their response times virtually coincide at both high and low overload current factors. In the range of the maximum permissible motor starting current, the response time T of the known protective element is too low. On the other hand, that of the protective element according to the invention is raised there, so that it is just above the permissible duration of the motor starting current.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of United States is:

1. A protective circuit having a construction which protects a motor against electrical overload conditions, and permits normal operation under predetermined starting current conditions of the motor, the circuit comprising: a PTC protective element for protecting the motor against overloading, comprising two contact terminals and a resistor core arranged between the two contact terminals having a predetermined switching temperature, the resistor core comprising a polymer matrix and a first powdered filler of a conductive material and also a second powdered filler, the second filler being provided in microencapsulated form and comprising a phase transition material which, at a critical temperature ($T_c$), undergoes a solid-liquid phase transition in which it absorbs heat of transformation, wherein the critical temperature ($T_c$) lies below the switching temperature and wherein the second filler is selected from the group consisting of UHMWPE, quinol, metal alloy and salt.

2. The circuit as claimed in claim 1, wherein the second powdered filler comprises a phase transition material which undergoes a solid-solid phase transition.

3. The circuit as claimed in claim 2, wherein the second filler comprises a phase transition material selected from the group consisting of pentaerythritol, $NaNO_2$, $NaNO_3$.

4. The circuit of claim 1, wherein the heat of transformation of the phase transition material is in each case at least 40 J/cm$^3$.

5. The circuit as claimed in claim 1, wherein the polymer matrix comprises polyethylene.

6. The circuit as claimed in claim 1, wherein the polymer matrix comprises fluorothermoplastic.

7. An electrical system comprising an electric motor connected in series with the protective circuit of claim 1.

8. The circuit as claimed in claim 1, wherein the polymer matrix comprises thermoplastic.

9. The circuit as claimed in claim 1, wherein the polymer matrix comprises ETFE.

10. The circuit of claim 1, wherein the polymer matrix has a melting point of at least 200° C. and no more than 270° C.

11. The circuit of claim 10, wherein the melting point is between 210° C. and 270° C.

12. The circuit of claim 1, wherein the polymer matrix has a melting point of 135° C.

13. The circuit of claim 1, wherein the resistor core comprises 20% by volume of the second filler.

14. The circuit of claim 1, wherein the resistor core comprises 40% by volume of the polymeric matrix, 40% by volume of the first conductive filler, and 20% by volume of the second filler.

* * * * *